US007892301B2

(12) United States Patent
Waters et al.

(10) Patent No.: US 7,892,301 B2
(45) **Date of Patent: *Feb. 22, 2011**

(54) LOW MOLECULAR WEIGHT FUEL ADDITIVE

(75) Inventors: Paul F. Waters, Washington, DC (US); John B. Waters, Washington, DC (US)

(73) Assignee: Himmelsbach Holdings, LLC, Washington, DC (US)

( * ) Notice: Subject to any disclaimer, the term of this patent is extended or adjusted under 35 U.S.C. 154(b) by 1226 days.

This patent is subject to a terminal disclaimer.

(21) Appl. No.: 11/414,249

(22) Filed: Apr. 27, 2006

(65) Prior Publication Data

US 2006/0254131 A1 Nov. 16, 2006

Related U.S. Application Data

(63) Continuation-in-part of application No. 11/116,074, filed on Apr. 27, 2005, now Pat. No. 7,727,291.

(51) Int. Cl.
*C10L 1/16* (2006.01)

(52) U.S. Cl. ..... 44/459; 585/14

(58) Field of Classification Search ..... 44/459; 585/14

See application file for complete search history.

(56) References Cited

U.S. PATENT DOCUMENTS

| | | | | |
|---|---|---|---|---|
| 2,049,062 | A | 7/1936 | Howard et al. | |
| 2,096,218 | A | 10/1937 | Voorhees | |
| 2,121,998 | A | 6/1938 | Tilton | |
| 2,896,593 | A | 7/1959 | Riemenschneider | |
| 2,985,578 | A | 5/1961 | Jonach | |
| 3,085,978 | A | 4/1963 | Mitacek et al. | |
| 3,215,154 | A | 11/1965 | White et al. | |
| 3,488,704 | A | 1/1970 | Lovett et al. | |
| 3,502,451 | A | 3/1970 | Moore et al. | |
| 3,547,819 | A | 12/1970 | Davis et al. | |
| 3,615,284 | A | 10/1971 | Cassar | |
| 3,672,852 | A | 6/1972 | Vermillion et al. | |
| 3,692,676 | A | 9/1972 | Culter et al. | |
| 3,996,023 | A | 12/1976 | Osmond et al. | |
| 4,357,148 | A | 11/1982 | Graiff | |
| 4,375,973 | A | 3/1983 | Rossi et al. | |
| 4,533,482 | A | 8/1985 | Bollinger | |
| 4,659,336 | A | 4/1987 | Sung et al. | |
| 4,747,851 | A | 5/1988 | Sung et al. | |
| 4,789,383 | A | 12/1988 | O'Mara et al. | |
| 5,114,435 | A | 5/1992 | Abramo et al. | |
| 5,321,172 | A | 6/1994 | Alexander et al. | |
| 5,460,633 | A * | 10/1995 | Smith et al. | 44/335 |
| 5,621,154 | A | 4/1997 | Wright et al. | |
| 5,906,665 | A | 5/1999 | Trippe et al. | |
| 5,965,498 | A | 10/1999 | Smythe | |
| 6,048,373 | A | 4/2000 | Malfer et al. | |
| 6,511,518 | B1 | 1/2003 | Houser | |
| 6,579,329 | B1 * | 6/2003 | Thomas et al. | 44/388 |
| 2003/0167679 | A1 | 9/2003 | Jordan | |
| 2004/0249233 | A1 | 12/2004 | Waynick | |

FOREIGN PATENT DOCUMENTS

| | | | |
|---|---|---|---|
| CA | 1205631 | * | 6/1986 |
| DE | 10109260 | A1 | 5/2002 |
| EP | 0078998 | A2 | 5/1983 |
| GB | 1569344 | * | 6/1980 |
| GB | 1569344 | A | 11/1980 |
| WO | 0148120 | A1 | 7/2001 |

OTHER PUBLICATIONS

Waters, P.F., Trippe, J, "New Concepts in Octane Boosting of Fuel for Internal Combustion Engines," *Division of Fuel Chemistry Preprints*, vol. 45, No. 3, p. 602, American Chemical Society, Washington, DC, Aug. 2000.

Waters, P.F., Hadermann, A.F. And Trippe, J., "Solution Processing of Megadalton Molecular Weight Macromolecules," *Proceedings of the Second International Conference on Reactive Processing of Polymers*, p. 11, J.T. Lindt, Ed., Univ. of Pittsburgh, Nov. 2-4, 1982.

Waters, P.F., Hadermann, A.F. and Trippe, J., "The Effect of Molecular Weight of Additives on the Properties of Antimisting Fuels," *Division of Petroleum Chemistry Preprints*, vol. 28, No. 5, p. 1153, 186th National Meeting of the American Chemical Society, Washington DC, 1983.

Hadermann, AF, "A Paradigm Shift Occurs in Fuel Additive Technology," 1995.

Hadermann, A.F., "Extensional Viscosity and Single Phenomenological Basis for the GTA Fuel Additive," 1995.

(Continued)

*Primary Examiner*—Cephia D Toomer
(74) *Attorney, Agent, or Firm*—Fredrikson & Byron, P.A.

(57) ABSTRACT

The invention includes a method of improving the combustion efficiency of a fuel-burning device. The method includes the steps of adding a low molecular weight polymer to the fuel of the fuel-burning device and burning the fuel with the polymer in the fuel-burning device. The invention also includes fuel compositions containing such polymers.

39 Claims, No Drawings

OTHER PUBLICATIONS

Waters, P.F., "A Physical Solution to Engine Knock," SAE Technical Paper Series 2002-01-2835, 2002.

Waters, J.B., "Note on the Federal Test Procedure (FTP) and Our Polymeric Fuel Additive" (2004).

P.F. Waters, Verdant vehicles via viscoelasticity, Clean Products and Processes 2 (2000) 133-139.

Paul F. Waters, Global Warming Reduction by Polymers in Automotive Fuels, Polymer Preprints 2000, 41(2).

Economic Aspects of Conversion to Antimisting Kerosene, Final Report, Nov. 1981, Aerospace Report No. ATR-81 (6862)-IND, Federal Aviation Administration Office of Aviation Safety, Washington, DC and Technical Center, Atlantic City, NJ, Transportation Directorate, Government Support Operations, The Aerospace Corporation, El Segundo, California.

Paul F. Waters and Albert F. Hadermann, Polyisobutene—The Ideal Drag Reduction Additive for Hydrocarbon-Carrying Pipelines, Proceedings of the Second International Symposium on Colloid Chemistry in Oil Production ISCOP'97, Rio de Janeiro, Brazil, Aug. 31 to Sep. 3, 1997.

T.H. Valtadoros, V.W. Wong, and J.B. Heywood, Fuel Additive Effects on Deposit Build-up and Engine Operating Characteristics, Symposium on Fuel Composition/Deposit Formation Tendencies presented before the Division of Petroleum Chemistry, Inc., American Chemical Society, Atlanta Meeting, Apr. 14-19, 1991.

Michael Golombok, Gautam T. Kalghatgi, and Adam Tindall, Heat Release and Knock in Paraffinic and Aromatic Fuels and the Effect of an Ashless Anti-knock Additive, SAE Technical Paper Series, 952405, Fuels & Lubricants Meeting and Exposition, Toronto, Ontario Oct. 16-19, 1995.

* cited by examiner

LOW MOLECULAR WEIGHT FUEL ADDITIVE

RELATED APPLICATIONS

This application is a continuation-in-part of U.S. patent application Ser. No. 11/116,074, filed Apr. 27, 2005, now U.S. Pat. No. 7,727,291 and titled Low Molecular Weight Fuel Additive, the contents of which are hereby incorporated by reference.

FIELD OF THE INVENTION

The invention generally relates to improving the combustion efficiency of a fuel-burning device. More specifically, the invention relates to improving the combustion efficiency of a fuel-burning device by adding an appropriate low molecular weight polymer to fuel.

BACKGROUND OF THE INVENTION

The efficiency of combustion of fuel-burning devices is a factor in the level of emissions of such devices. For example, when the fuel-burning device is an internal combustion (IC) engine such as in an automobile, the efficiency of combustion is a determinant of the level of release of greenhouse gases attainable by the automobile.

The efficiency of combustion of a liquid fuel in a fuel-burning device depends on the uniformity of the air/fuel mixture at the time of combustion. The uniformity of the air/fuel mixture may be increased by providing the fuel with viscoelastic properties, which may be accomplished by adding a polymer to the fuel. As the viscoelastic effectiveness of dilute polymer solutions is linear in polymer concentration and parabolic in molecular weight, a traditional method of improving the efficiency of combustion of a liquid fuel in a fuel-burning device is to add a high molecular weight polymer to the fuel.

That the polymer be of a high molecular weight is emphasized in the prior art. For example, in U.S. Pat. No. 5,906,665 (the '665 patent), high molecular weight polyisobutylene (PIB) was introduced into the fuel charge of an IC engine to provide viscoelastic properties to the fuel. The viscoelasticity imparted to the fuel results in a more uniform air/fuel mixture and, thus, more efficient combustion when compared to neat fuel. In the '665 patent, the extensional viscosity is shown to be proportional to $cM^{(1+2\alpha)}$, where c is the concentration, M is the viscosity average molecular weight of the polymer, and $\alpha$ is the exponent of M in the Mark-Houwink equation. Therefore, increasing the molecular weight of the polymer is taught as providing greater combustion efficiency.

Further, in Waters, P. F., Hadermann, A. F. and Trippe, J., "Solution Processing of Megadalton Molecular Weight Macromolecules," Proceedings of the Second International Conference on Reactive Processing of Polymers, p. 11, J. T. Lindt, Ed., Univ. of Pittsburgh, Nov. 2-4, 1982, the antimisting effect of ultra high molecular weight macromolecules was examined in order to emphasize the significance of the contribution of the high molecular weights of these macromolecules to the viscoelastic properties of polymer solutions. The authors demonstrated that the higher the molecular weight of a polymer, the greater the antimisting effect of that polymer in solution; indeed, the measure of the effect increased parabolically with respect to its molecular weight. Since the antimisting effect of a polymer solution is a function of its viscoelasticity, it was concluded that an appropriate polymer of a higher molecular weight has a greater viscoelastic effect on a fuel.

In addition, in Waters, P. F., Hadermann, A. F. and Trippe, J., "The Effect of Molecular Weight of Additives on the Properties of Antimisting Fuels," Division of Petroleum Chemistry Preprints, Vol. 28, No. 5, p. 1153, 186$^{th}$ National Meeting of the Am. Chem. Soc., Washington, D.C., 1983, the influence of the molecular weight on the height-at-break property of a column of polymer solution induced by a ductless siphon, the antimisting effectiveness, and, thus, the flammability suppression potential of PIB in isooctane were studied. The authors concluded that antimisting fuels containing ultra high molecular weight macromolecules show markedly superior antimisting effectiveness when compared to antimisting fuels containing the same concentration of lower molecular weight macromolecules. Therefore, it has been customary to select the highest molecular weight of an appropriate polymer to provide the desired viscoelastic properties to fuel.

SUMMARY OF THE INVENTION

In some embodiments, the invention includes a method of improving the combustion efficiency of a fuel-burning device comprising adding a low molecular weight polymer to the fuel of the fuel-burning device and burning the fuel with the polymer in the fuel-burning device. The invention also includes a fuel-burning device efficiency enhancing composition comprising a low molecular weight polymer in a fuel. Surprisingly, the methods and compositions of the present invention increase combustion efficiency as much as, or more than, traditional methods of improving the efficiency of combustion that rely on an appropriate high molecular weight polymer. At the same time, the methods and compositions of the present invention provide several advantages over relatively higher molecular weight polymers, including advantages related to availability, cost and convenience.

DETAILED DESCRIPTION OF THE INVENTION

In some embodiments, the invention includes a method of improving the combustion efficiency of a fuel-burning device by adding an effective amount of a low molecular weight polymer to the fuel of the fuel-burning device and burning the fuel with the polymer in the fuel-burning device. Such low molecular weight polymers improve combustion efficiency as much as, or more than, high molecular weight polymers. The term, "polymer," may signify a polymer appropriate for adding to fuel; and may also include a polymer distributed in a carrier, whether liquid or otherwise, where such polymer distributed in a carrier is appropriate for adding to fuel.

Any low molecular weight polymer, copolymer, terpolymer (or combination of monomers) that is soluble in fuel, and imparts sufficient viscoelasticity to the fuel, may improve combustion efficiency. Examples of low molecular weight polymers suitable for use in the present invention include polyisobutylene (PIB). Other examples of low molecular weight polymers that may be suitable for use in the invention include polybutadiene, styrene-butadiene rubber, butyl rubber, ethylene-propylene rubber, polyisoprene, polystyrene-polyisoprene copolymers, copolymers of ethylene and butene-1, and combinations or blends thereof. Still other polymers that may be suitable include polypropylene oxide and polymethylmethacrylate. Desirably, the polymer is soluble at useful concentrations in the fuel. In some embodiments, the polymer comprises monomers having a carbon chain length of 2 to 6 carbons. One preferred low molecular weight polymer used in several embodiments of the present invention comprises PIB.

Generally, with regard to the present invention, low molecular weight means less than 4 million Daltons (e.g., about 0.2 million to 4 million Daltons). In some embodiments, the polymer has a molecular weight of less than about 3.9 million Daltons (e.g., about 1 million to about 3.9 million Daltons). In other embodiments, the polymer has a molecular weight of less than about 3.8 million Daltons (e.g., about 1 million to about 3.8 million Daltons). In yet other embodiments, the polymer has a molecular weight of less than about 3.7 million Daltons (e.g., about 1 million to about 3.7 million Daltons). Further, some embodiments of the polymer have a molecular weight of less than about 3.6 million Daltons (e.g., about 1 million to about 3.6 million Daltons). In some embodiments, the polymer has a molecular weight of less than about 3.5 million Daltons (e.g., about 3.2 million to about 3.5 million Daltons). In other embodiments, the polymer has a molecular weight of less than about 3.4 million Daltons (e.g., about 1 million to about 3.4 million Daltons). In yet other embodiments, the polymer has a molecular weight of less than about 3.3 million Daltons (e.g., about 1 million to about 3.3 million Daltons). In some embodiments, the polymer has a molecular weight of less than about 3.2 million Daltons (e.g., about 1 million to about 3.2 million Daltons). In yet other embodiments, the polymer has a molecular weight of less than about 3.1 million Daltons (e.g., about 1 million to about 3.1 million Daltons). In some embodiments, the polymer has a molecular weight of less than about 3 million Daltons (e.g., about 2.2 million to about 2.6 million Daltons). In yet other embodiments, the polymer has a molecular weight of less than about 2 million Daltons (e.g., about 1.2 million to about 1.6 million Daltons). In other embodiments, the polymer has a molecular weight of less than about 1 million Daltons (e.g., about 0.2 million to about 0.5 million Daltons). The molecular weight of the polymer may be determined in a variety of ways, such as by measuring the dynamic viscosity of polymer solutions relative to the dynamic viscosity of the solvent to determine the viscosity average molecular weight ($M_v$).

The polymer may be added to the fuel in any concentration suitable to be effective in increasing combustion efficiency. In some embodiments, the polymer is added to the fuel in a concentration range of about 0.1 to about 100 ppm by weight. In other embodiments, the polymer is added to the fuel in a concentration range of about 0.1 to about 80 ppm by weight (e.g., about 60 ppm to about 80 ppm). In other embodiments, the polymer is added to the fuel in a concentration range of about 1 to about 60 ppm by weight (e.g., about 30 ppm to about 40 ppm). In other embodiments, the polymer is added to the fuel in a concentration range of about 1 to about 20 ppm by weight (e.g., about 12 ppm to about 15 ppm). In yet other embodiments, the polymer is added to the fuel in a concentration range of about 1 to about 15 ppm by weight (e.g., about 5 to about 15 ppm). In some embodiments, the polymer is added to the fuel in a concentration range of about 1 to about 10 ppm by weight (e.g., about 5 to about 10 ppm). In other embodiments, the polymer is added to the fuel in a concentration range of about 5 to about 10 ppm by weight (e.g., about 10 ppm). In yet other embodiments, the polymer is added to the fuel in a concentration range of about 0.1 to about 5 ppm by weight (e.g., about 5 ppm).

The fuel-burning device may be any device capable of burning fuel. In some embodiments, the fuel-burning device is selected from the group consisting of gasoline engines, diesel engines, jet engines, marine engines, furnaces and burners. Further, such fuel-burning devices may not require structural modifications (e.g., modifying a fuel injector spray angle, or nozzle, or orifice diameter) to burn the fuel and the polymer.

The polymer may be added to the fuel at any suitable time. In some embodiments, the polymer is added to a fuel tank of the fuel-burning device that contains fuel. In other embodiments, the polymer is metered into the fuel system of the fuel-burning device by an additive injection system. In yet other embodiments, the polymer is added to the fuel prior to adding the fuel to the tank of the fuel-burning device, including at the refinery.

The fuel may comprise any combustible liquid hydrocarbon, including, for example, gasoline of all octane ratings (e.g., leaded and unleaded and/or MTBE and ethanol-containing grades), diesel (e.g., low sulfur diesel, ultra low sulfur diesel, Fischer-Tropsch Diesel, biodiesel, and/or off-road diesel), jet fuel (e.g., Jet A, JP-4, JP-5, and/or JP-8), marine fuel (e.g., IFO 180, IFO 380, MDO, and/or MGO), and heating oil.

The invention also includes a fuel-burning device efficiency enhancing fuel composition comprising any of the polymers described above, which may be made by any suitable method. For example, the product may be made by dissolving the polymer in a solvent (e.g., isooctane) at room temperature to produce a dilute (e.g., about 0.1, 0.5, 1, 1.5, 2 or 5% by weight) solution. This may be accomplished by adding small pieces of the polymer to the solvent while stirring occasionally with a flat paddle for a suitable duration (e.g., 24 hours). The solution may be further diluted, if desired, and added to fuel in an amount sufficient to achieve a target concentration.

The methods and compositions of the low molecular weight polymers of the present invention provide several advantages over relatively higher molecular weight polymers, including advantages related to availability, cost and convenience. For example, low molecular weight polymers are more widely available compared to many specialized, high molecular weight polymers. Further, low molecular weight polymers are less costly to produce than higher molecular weight polymers. For example, PIB at 2.6 megadaltons is more widely used and less costly than PIB at 7.2 megadaltons. The methods and compositions of the low molecular weight polymers of the present invention also provide several processing and performance advantages over relatively higher molecular weight polymers. For example, a low molecular weight polymer such as PIB can be dissolved more quickly and more easily than a higher molecular weight polymer. Further, the smaller molecules of a low molecular weight polymer produce a lower cloud point than the larger molecules of a higher molecular weight polymer. In addition, a low molecular weight polymer is less likely to precipitate from solution, especially in cold climates, compared to a higher molecular weight polymer. Moreover, a low molecular weight polymer distributed in a liquid carrier is less viscous and so is likely to exhibit less pituitance than a higher molecular weight polymer distributed in a liquid carrier.

It is counterintuitive to expect, given the strong dependence of viscoelasticity on M in the equation described with reference to the '665 patent above, that lower values of M at the same concentration would prove at least as effective as the higher molecular weight species discussed in the '665 patent; nevertheless, a low molecular weight polymer is as good as, or better than, a high molecular weight polymer in reducing exhaust emissions of hydrocarbons (HC), carbon monoxide (CO), nitrogen oxides (NOx), carbon dioxide ($CO_2$), and soot from an IC engine. For example, the '665 patent reports a 1.9% reduction in the emission of $CO_2$ when 6.3 megadalton PIB is present in fuel at 10 ppm (Example 13). In contrast, a 79% reduction in the emission of $CO_2$ was achieved in one embodiment of the present invention when 2.6 megadalton PIB was in fuel at 10 ppm (as discussed in Example 4, below). Moreover, the reduction in the emission of $CO_2$ may be taken as a measure of the relative efficiency of the conversion of chemical potential energy into work in the engines, the level of $CO_2$ emitted for comparable work being a direct correlate of the volume of fuel burned per unit time.

Without being limited to any particular theory of operation, the effectiveness of the present invention is believed to be related to a change it effects in the physical properties of the fuel. By imparting a viscoelasticity to carbureted or injected HC fuel, the polymer controls the physics of the combustion of the fuel. The viscoelasticity curtails the formation of colloid-size droplets and reduces the net droplet surface area. This, in turn, serves as a rate-limiting mechanism for the control of the initial rapid chemistry, which would otherwise lead to the high-temperature spike observed in the combustion of an identical HC fuel without the polymer present. By inhibiting the surface-related rapid chemistry, the polymer reduces the combustion emissions of HC fuels such as NOx, soot, partially oxidized HC, and unburned HC.

Further, the viscoelastic stress constrains the "light" and "heavy" HC fuel molecules within individual droplets by stretching the random coil polymer molecules, rigidizing them within the droplets and at the surface, where the alignments confer an increased surface tension that persists until the internal droplet heat randomizes the unit spatial distribution within the polymer molecules. In this higher entropy state, the polymer no longer restrains the HC fuel molecules within the droplets and they escape to burn contiguously and cooperatively at rates intermediate between the normal "light" and "heavy" fractions. This leads to "early burn" in the power stroke, restricted accumulation of "heavy" ends in the end gas, and lower temperatures in the exhaust system. This latter-phase process is accelerated by the presence of oxygen that was not consumed due to limited oxidation at the lower temperatures in the initial, surface-related chemical reactions.

As described herein, the methods and compositions of the present invention increase combustion efficiency as much as, or more than, traditional methods of improving the efficiency of combustion that rely on an appropriate high molecular weight polymer. Aerosolized polymeric-additive-treated fuel is subject to extreme temperatures after the injection into the cylinder but before combustion. In this pre-combustion phase, the heat is absorbed by the fuel droplets from the cylinder walls, causing the elongated polymer molecules contained in them to revert. The viscoelastic effect now mitigated, the fuel molecules may escape from the droplets and the polymer molecules revert further into a random compact coil as they come out of solution and/or are burned. Without intending to be bound by theory, it appears that high molecular weight polymers, such as those described in the '665 patent, may precipitate more readily than low molecular weight polymers, and are, therefore, not able to sustain the viscoelasticity of the fuel droplets for the same duration in the combustion process.

Polymers such as those described above provide several advantages compared to neat fuels. These advantages may be generically described as increasing combustion efficiency. For example, such polymers may increase the octane/cetane value of the fuel, reduce fuel vaporization in the combustion chamber, narrow the size distribution of the fuel droplets, reduce the formation of submicron-size droplets, increase momentary viscosity, increase volumetric efficiency of 4 and 2 cycle engines, reduce fractional distillation in the combustion chamber, reduce the tendency of the injectors to dry, reduce flow resistance in the entire fuel system (i.e., drag reduction), increase lubrication in the fuel system, increase fuel efficiency, reduce undesirable surface coating in the combustion chamber, increase diffuse burning, develop a uniform cloud mix for improved combustion, improve cold/warm engine starting, promote diesel-fuel jet penetration prior to ignition and diffuse burning, increase acceleration, increase engine smoothness, increase fuel mileage, increase horsepower, reduce exhaust smoke, and/or reduce emissions of HC, CO, NOx, and $CO_2$.

In addition to the advantages just cited, polymers, in accordance with the present invention, may reduce combustion chamber temperatures; reduce performance-based and temperature-based knock; reduce exhaust temperatures; reduce engine vibration and noise; reduce brake specific fuel consumption (BSFC); reduce soot formation; reduce emissions of polyaromatic hydrocarbons (PAHs) and partially oxidized HC; simultaneously reduce emissions of NOx and PM; reduce back pressure in the intake manifold; increase peak pressure; reduce exhaust manifold pressure; increase torque; enhance performance during transients; reduce mechanical stress in engines (as a byproduct of the lower operating temperatures and knock prevention); increase the stability of engine lubricants (as a byproduct of the lower operating temperatures); and/or reduce the rate of fuel evaporation in the fuel system.

Some embodiments of the invention are particularly suitable for reducing NOx emissions in the combustion of biodiesel fuels. Biodiesel fuels include fuels comprising vegetable oils (e.g., soybean) and/or animal fats. Such fuels are prone to producing large amounts of NOx in conventional internal combustion engines. Some embodiments of the invention include methods of reducing NOx emissions during the combustion of a biodiesel fuel in an internal combustion engine by adding a polymer having a molecular weight of less than 4 million Daltons to the biodiesel. Embodiments of the invention also include a fuel composition comprising biodiesel and a polymer having a molecular weight of less than 4 million Daltons.

As described above, the present invention is useful for increasing the efficiency of combustion of a fuel-burning device and leading to a reduction in $CO_2$ emissions. It has also been observed that when the fuel-burning device is an IC engine, such as in an automobile, use of the present invention in the fuel-burning device results in an increase in fuel mileage. It has been found that fuels, including the low molecular weight polymers of the present invention, preferably reduce $CO_2$ emissions by greater than about 20% compared to neat fuels, more preferably by greater than about 40% compared to neat fuels, and most preferably by greater than about 60% compared to neat fuels. Furthermore, it has been found that the fuels that include the low molecular weight polymers of the present invention preferably increase fuel mileage by more than about 5% compared to neat fuels, and more preferably increase fuel mileage by more than about 10% compared to neat fuels.

EXAMPLES

The following examples are presented for illustrative purposes and are not intended to limit the scope of the claims that follow.

For each example, the vehicle used is a 1995 TOYOTA COROLLA DX 4-Door Sedan equipped with a 1.8 liter, 115 HP, in-line 4-cylinder, 4-cycle gasoline engine, with a 4-speed, automatic transmission, and is designed to burn 87 octane gasoline. The oil sump holds 3.9 quarts (with filter) and the fuel tank capacity is 13.2 US gallons. For each fill, 87 octane gasoline from Pump #7 at the River Road GETTY gas station in Bethesda, Md. was used. Further, all emissions tests were conducted on Line 3 at the State of Maryland Vehicle Emissions Inspection Program (VEIP), Gaithersburg, Md., test facility.

Example 1

Preparation of Low Molecular Weight Polymer Solution

A solution of low molecular weight polymer was prepared for use in the examples below by dissolving 2.6 megadalton PIB in isooctane at room temperature to produce a 1% by weight solution. This was accomplished by adding small pieces of the PIB to the solvent while stirring occasionally with a flat paddle for a duration of 24 hours.

Example 2

Emissions Reduction and Mileage Improvement with 15 ppm of 2.6 Megadalton PIB Emissions from the test vehicle without polymer were measured to establish a baseline. The fuel tank of the vehicle was filled and the vehicle was driven from the gas station to the test facility, where it was tested for emissions under the following atmospheric conditions: 69 degrees F., with a pressure of 29.55 inches of mercury and a relative humidity of 56%. The baseline vehicle emissions are presented in Table 1.

The vehicle was then driven back to the gas station, where the tank of the vehicle was again filled. The amount of gasoline required to fill the tank was 2.029 US gallons. The test vehicle had averaged 27.6 miles per gallon while running on neat fuel.

Next, 2.64 ounces of PIB solution, prepared as described in Example 1, were added to the full tank at the gas station to achieve a 15 ppm solution of 2.6 megadalton PIB in the fuel, and the vehicle was driven back to the test facility where it was tested for emissions under the following atmospheric conditions: 72 degrees F., with a pressure of 29.6 inches of mercury and a relative humidity of 55%. The emissions measured from the test vehicle with polymer are shown in Table 2.

TABLE 1

Emissions measurements for neat fuel (grams per mile).

| TEST | SOURCE | HC | CO | NOx | $CO_2$ |
|---|---|---|---|---|---|
| 1 | VEIP | 0.3753 | 1.4603 | 0.6731 | 107.3724 |

TABLE 2

Emissions measurements with 15 ppm of 2.6 megadalton PIB (grams per mile).

| TEST | SOURCE | HC | CO | NOx | $CO_2$ |
|---|---|---|---|---|---|
| 1 | VEIP | 0.1422 | 0.5147 | 0.1170 | 35.6437 |
| | EMISSIONS REDUCTION | 62.11% | 64.75% | 82.62% | 66.80% |

As shown in Table 2, the effect of introducing a low molecular weight polymer of the present invention is a significant reduction in emissions. There is a direct correlation between a reduction in the emission of $CO_2$ and an increase in combustion efficiency; moreover, greater combustion efficiency results in the same output of mechanical work at a lower rate of fuel consumption.

Following the emissions test of which the results are shown in Table 2, the vehicle was driven 141.2 miles. On returning to the gas station, the vehicle tank was again filled. The fuel required was 4.600 US gallons. The vehicle had achieved an average 30.7 miles per gallon of fuel with polymer. Therefore, a 15 ppm solution of 2.6 megadalton PIB increased the average mileage by 11.2%.

Example 3

Emissions Reduction with 9.8 ppm of 2.6 Megadalton PIB

Before adding the 4.600 US gallons of fuel discussed in Example 2, there were 13.2−4.6=8.6 US gallons of 15 ppm PIB in the fuel. Therefore, after the addition of the 4.600 US gallons of fuel, the new concentration of PIB in the fuel was 9.8 ppm PIB in 13.2 US gallons.

The vehicle was again driven back to the test facility, where the atmospheric conditions were: 73 degrees F., with a pressure of 29.4 inches of mercury and a relative humidity of 52%.

TABLE 3

Emissions measurements for neat fuel (grams per mile), as presented in Table 1.

| TEST | SOURCE | HC | CO | NOx | $CO_2$ |
|---|---|---|---|---|---|
| 1 | VEIP | 0.3753 | 1.4603 | 0.6731 | 107.3724 |

The emissions measured from the test vehicle with polymer are shown in Table 4.

TABLE 4

Emissions measurements with 9.8 ppm of 2.6 megadalton PIB (grams per mile).

| TEST | SOURCE | HC | CO | NOx | $CO_2$ |
|---|---|---|---|---|---|
| 1 | VEIP | 0.0252 | 0.0406 | 0.0564 | 23.0914 |
| | EMISSIONS REDUCTION | 93.29% | 97.22% | 91.62% | 78.49% |

As shown in Table 4, low molecular weight polymers of the present invention are useful for significantly reducing emissions, which demonstrates an increase in combustion efficiency.

Following the test described in Example 3 above, the vehicle was driven for over 10,000 miles without further addition of polymer before a subsequent test series.

Example 4

Emissions Reduction with 10 ppm of 2.6 Megadalton PIB

The fuel tank of the vehicle was filled and no polymer was introduced into the fuel. The vehicle was then driven from the gas station to the test facility, where it was tested for emissions under the following atmospheric conditions: 81 degrees F., with a pressure of 29.2 inches of mercury and a relative humidity of 70%. The emissions measurements without polymer are presented in Table 5.

When the fuel tank of the test vehicle was again filled at the gas station, the solution of 2.6 megadalton PIB described in Example 1 was added to produce a 10 ppm by weight solution of PIB in the fuel.

The emissions measurements with polymer, the measurements having been recorded on each of three separate days, are presented in Table 6, where the average atmospheric conditions were: temperature 82 degrees F., with a pressure of 29.2 inches of mercury and a relative humidity of 70%.

TABLE 5

Emissions measurements for neat fuel (grams per mile)

| TEST | SOURCE | HC | CO | NOx | $CO_2$ |
|---|---|---|---|---|---|
| 1 | VEIP | 0.3649 | 1.9357 | 0.4342 | 131.2031 |

TABLE 6

Emissions measurements for the test vehicle running on the same tank of fuel with 10 ppm of 2.6 megadalton PIB (grams per mile).

| TEST | SOURCE | HC | CO | NOx | $CO_2$ |
|---|---|---|---|---|---|
| 1 | VEIP | 0.0276 | 0.2042 | 0.0573 | 26.5656 |
| 2 | VEIP | 0.0221 | 0.1927 | 0.0739 | 27.5532 |
| 3 | VEIP | 0.0161 | 0.1348 | 0.0680 | 27.9986 |
| AVERAGE | | 0.0219 | 0.1772 | 0.0664 | 27.3725 |
| EMISSIONS REDUCTION | | 93.99% | 90.85% | 84.71% | 79.14% |

As shown in Table 6, there is a reduction in emissions, which demonstrates an increase in combustion efficiency with a low molecular weight polymer of the present invention.

Following the test described in Example 4 above, the vehicle was driven for over 1,000 miles without further addition of polymer, in order to be certain that no polymer was present in the fuel system for a subsequent test series.

Example 5

Reduction in Emissions and Improvement in Fuel Mileage with 5 ppm of 2.6 Megadalton PIB The vehicle was filled with fuel and driven to the test facility. Emissions measurements without polymer are presented in Table 7, where atmospheric conditions were: 62 degrees F., with a pressure of 29.67 inches of mercury and a relative humidity of 62%.

TABLE 7

Emissions measurements for neat fuel (grams per mile)

| TEST | SOURCE | HC | CO | NOx | $CO_2$ |
|---|---|---|---|---|---|
| 1 | VEIP | 0.2132 | 1.0005 | 0.0331 | 111.2314 |

The test vehicle was then driven back to the gas station and the tank was filled. The fuel mileage recorded was 27.8 miles per gallon. Next, the solution of 2.6 megadalton PIB described in Example 1 was added to the fuel tank of the vehicle to produce a 5 ppm by weight solution of PIB in the fuel, and the vehicle was driven back to the test facility. The emissions measurements with polymer are presented in Table 8, where atmospheric conditions were 61.5 degrees F., with a pressure of 29.65 inches of mercury and a relative humidity of 61%.

TABLE 8

Emissions measurements with 5 ppm of 2.6 megadalton PIB (grams per mile)

| TEST | SOURCE | HC | CO | NOx | $CO_2$ |
|---|---|---|---|---|---|
| 1 | VEIP | 0.0024 | 0.1167 | 0.0706 | 28.3218 |
| EMISSIONS REDUCTION | | 98.87% | 88.34% | −113.29% | 74.54% |

The test vehicle was driven back to the gas station and the fuel tank filled. The fuel mileage recorded was 35.6 miles per gallon.

Therefore, as shown in Table 8 above, low molecular weight polymers of the present invention are useful for significantly reducing vehicle emissions; at the same time, a 5 ppm solution of 2.6 megadalton PIB increased the vehicle's fuel mileage by 28.1%.

Following the test described in Example 5 above, the vehicle was once again driven for over 1,000 miles without further addition of polymer, in order to be certain that no polymer was present in the fuel system for a subsequent test series.

Example 6

Reduction in Emissions and Improvement in Fuel Mileage with 5 ppm of 2.6 Megadalton PIB The vehicle was filled with fuel and then driven to the test facility. Emissions measurements without polymer are presented in Table 9, where atmospheric conditions were 32 degrees F., with a pressure of 29.9 inches of mercury and a relative humidity of 71.5%.

TABLE 9

Emissions measurements for neat fuel (grams per mile)

| TEST | SOURCE | HC | CO | NOx | $CO_2$ |
|---|---|---|---|---|---|
| 1 | VEIP | 0.5031 | 1.8327 | 1.0025 | 226.5451 |

The test vehicle was then driven back to the gas station and the tank was filled. The fuel mileage recorded was 31.4 miles per gallon. Next, the solution of 2.6 megadalton PIB described in Example 1 was added to the fuel tank of the vehicle to produce a 5 ppm by weight solution of PIB in the fuel, and the vehicle was driven back to the test facility. The emissions measurements with polymer are presented in Table 10, where atmospheric conditions were 34 degrees F., with a pressure of 29.5 inches of mercury and a relative humidity of 56%.

TABLE 10

Emissions measurements with 5 ppm of 2.6 megadalton PIB (grams per mile)

| TEST | SOURCE | HC | CO | NOx | $CO_2$ |
|---|---|---|---|---|---|
| 1 | VEIP | 0.0297 | 0.1107 | 0.1088 | 32.7280 |
| EMISSIONS REDUCTION | | 94.10% | 93.96% | 89.15% | 85.55% |

The test vehicle was then driven to the gas station and the fuel tank filled. The fuel mileage recorded was 37.0 miles per gallon.

Therefore, as shown in Table 10 above, low molecular weight polymers of the present invention are useful for significantly reducing vehicle emissions; at the same time, a 5 ppm solution of 2.6 megadalton PIB increased the vehicle's fuel mileage by 17.8%.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations, which fall within the spirit and broad scope of the invention.

What is claimed is:

1. A method of improving the combustion efficiency of a fuel-burning device, comprising:

adding a polymer to the fuel of the fuel-burning device at a concentration range of about 0.1 to about 80 ppm by weight, wherein the polymer is polyisobutylene, the polyisobutylene having a viscosity average molecular weight of about 2.6 million Daltons, and burning the fuel with the polymer in the fuel-burning device.

2. The method of claim 1, wherein the polymer is added to the fuel in a concentration range of about 1 to about 20 ppm by weight.

3. The method of claim 1, wherein the polymer is added to the fuel in a concentration range of about 5 to about 10 ppm by weight.

4. The method of claim 1, wherein the fuel-burning device is selected from the group consisting of gasoline engines, diesel engines, jet engines, marine engines, furnaces and burners.

5. The method of claim 1, wherein the polymer is added to a fuel tank of the fuel-burning device.

6. The method of claim 5, wherein the polymer is added to the fuel prior to adding the fuel to the tank of the fuel-burning device.

7. The method of claim 1, wherein the polymer has a viscosity average molecular weight of about 2.6 million Daltons in a concentration range of about 0.1 to about 60 ppm by weight in the fuel.

8. The method of claim 1, wherein carbon dioxide emission rates are reduced by more than about sixty percent compared to neat fuel.

9. The method of claim 1, wherein the fuel-burning device is an internal combustion engine in a vehicle and fuel mileage is increased by at least about ten percent compared to neat fuel.

10. The method of claim 1, wherein the fuel is selected from the group consisting of gasoline, diesel, jet fuel, marine fuel, and heating oil.

11. The method of claim 1, wherein the fuel includes biodiesel.

12. A method of improving the combustion efficiency of a fuel-burning device, comprising:

adding a polymer to the fuel of the fuel-burning device, wherein the polymer is polyisobutylene having a viscosity average molecular weight of 2.6 million Daltons in a concentration range of about 0.1 to about 100 ppm by weight in the fuel, and burning the fuel with the polymer in the fuel-burning device.

13. The method of claim 12, wherein the polymer is added to the fuel in a concentration range of about 1 to about 20 ppm by weight.

14. The method of claim 12, wherein the polymer is added to the fuel in a concentration range of about 5 to about 10 ppm by weight.

15. The method of claim 12, wherein the fuel-burning device is selected from the group consisting of gasoline engines, diesel engines, jet engines, marine engines, furnaces and burners.

16. The method of claim 12, wherein the polymer is added to a fuel tank of the fuel-burning device.

17. The method of claim 16, wherein the polymer is added to the fuel prior to adding the fuel to the tank of the fuel-burning device.

18. The method of claim 12, wherein the polymer has a viscosity average molecular weight of about 2.6 million Daltons in a concentration range of about 0.1 to about 60 ppm by weight in the fuel.

19. The method of claim 12, wherein carbon dioxide emission rates are reduced by more than about sixty percent compared to neat fuel.

20. The method of claim 12, wherein the fuel-burning device is an internal combustion engine in a vehicle and fuel mileage is increased by at least about ten percent compared to neat fuel.

21. The method of claim 12, wherein the fuel is selected from the group consisting of gasoline, diesel, jet fuel, marine fuel, and heating oil.

22. The method of claim 12, wherein the fuel includes biodiesel.

23. A method of improving the combustion efficiency of a fuel-burning device, comprising:

adding a polyisobutylene having a viscosity average molecular weight of about 1 million to about 3.3 million Daltons to the fuel of the fuel-burning device until a concentration of 0.1 to 80 ppm by weight is reached, and burning the fuel with the polymer in the fuel-burning device.

24. The method of claim 23, wherein the polyisobutylene has a viscosity average molecular weight of about 2.2 million to about 2.6 million Daltons.

25. The method of claim 23, wherein the polyisobutylene has a viscosity average molecular weight of about 1.2 million to about 1.6 million Daltons.

26. The method of claim 23, the polyisobutylene having a viscosity average molecular weight of about 2.6 million Daltons.

27. The method of claim 23, wherein the polyisobutylene is added to the fuel in a concentration range of about 1 to about 20 ppm by weight.

28. The method of claim 23, wherein the polyisobutylene is added to the fuel in a concentration range of about 5 to about 10 ppm by weight.

29. The method of claim 23, wherein the fuel-burning device is selected from the group consisting of gasoline engines, diesel engines, jet engines, marine engines, furnaces and burners.

30. The method of claim 23, wherein the polymer is added to a fuel tank of the fuel-burning device.

31. The method of claim 30, wherein the polymer is added to the fuel prior to adding the fuel to the tank of the fuel-burning device.

32. The method of claim 23, wherein carbon dioxide emission rates are reduced by more than about sixty percent compared to neat fuel.

33. The method of claim 23, wherein the fuel-burning device is an internal combustion engine in a vehicle and fuel mileage is increased by at least about ten percent compared to neat fuel.

34. The method of claim 23, wherein the fuel is selected from the group consisting of gasoline, diesel, jet fuel, marine fuel, and heating oil.

35. The method of claim 23, wherein the fuel includes biodiesel.

36. A method of adding a polymer to a fuel tank, comprising:

dissolving a polymer in a solvent to create a solution, wherein the polymer includes polyisobutylene, the polyisobutylene having a viscosity average molecular weight of about 2.6 million Daltons, and adding the solution to a fuel in the fuel tank of a fuel-burning device until the polymer has a concentration in the fuel of about 0.1 to about 80 ppm.

37. The method of claim 36, wherein the solvent comprises isooctane.

38. The method of claim 36, wherein the solution comprises 1 percent of the polymer by weight.

39. The method of claim 36, wherein the polymer is added to the fuel in a concentration range of about 0.1 to about 60 ppm by weight.

* * * * *